US007073424B2

(12) United States Patent
Ferrari et al.

(10) Patent No.: US 7,073,424 B2
(45) Date of Patent: Jul. 11, 2006

(54) METHOD AND PLANT FOR THE DESTRUCTION OF A FUZE MOUNTED ON A MUNITION

(75) Inventors: Marc Ferrari, Vert le Petit (FR); Marie Gaudre, Le Haillan (FR); Jean-Michel Tauzia, Blanquefort (FR)

(73) Assignee: SNPE Materiaux Energetiques, Paris (FR)

( * ) Notice: Subject to any disclaimer, the term of this patent is extended or adjusted under 35 U.S.C. 154(b) by 0 days.

(21) Appl. No.: 10/471,404

(22) PCT Filed: May 17, 2002

(86) PCT No.: PCT/FR02/01669

§ 371 (c)(1),
(2), (4) Date: Sep. 11, 2003

(87) PCT Pub. No.: WO02/095322

PCT Pub. Date: Nov. 28, 2002

(65) Prior Publication Data

US 2004/0107824 A1 Jun. 10, 2004

(30) Foreign Application Priority Data

May 21, 2001 (FR) ..... 01 06655

(51) Int. Cl.
*F42B 33/06* (2006.01)

(52) U.S. Cl. ..... 86/50

(58) Field of Classification Search ..... 86/50; 588/202, 203, 403

See application file for complete search history.

(56) References Cited

U.S. PATENT DOCUMENTS

| | | | | |
|---|---|---|---|---|
| 2,778,311 | A * | 1/1957 | Roberts et al. | 102/228 |
| 3,108,918 | A * | 10/1963 | Plumley | 216/92 |
| 5,274,356 | A * | 12/1993 | Taricco | 340/515 |
| 5,430,228 | A * | 7/1995 | Ciambrone et al. | 588/320 |
| 5,574,203 | A * | 11/1996 | Noel et al. | 588/299 |
| 5,668,342 | A * | 9/1997 | Discher | 86/50 |
| 5,714,707 | A * | 2/1998 | Ruia | 86/49 |
| 6,011,193 | A * | 1/2000 | Myler et al. | 588/318 |
| 6,173,662 | B1 * | 1/2001 | Donovan | 110/237 |
| 6,470,783 | B1 * | 10/2002 | Ito et al. | 86/50 |

(Continued)

FOREIGN PATENT DOCUMENTS

DE 4240394 A1 * 6/1994

(Continued)

OTHER PUBLICATIONS

WO 93/17295, Sep. 1993, Lamnevik.*

*Primary Examiner*—Troy Chambers
(74) *Attorney, Agent, or Firm*—Oliff & Berridge, PLC

(57) ABSTRACT

The invention concerns the field of ammunitions equipped with their fuze, found on the battlefield. Such ammunitions represent a major pyrotechnic risk. The problem consists in destroying the fuze so as to be able to dismantle said ammunition. The method consists in placing said ammunition (1) in a closed chamber (5) to carry out at least once the following cycle: depressurizing the chamber (5), dissolving the fuze (2) of the ammunition (1) with a liquid corrosive agent, drawing off the gaseous effluents towards an auxiliary chamber (7), reopening the chamber (5) after dissolving the fuze (2), removing the ammunition (1), recovering the mixture resulting from the attack of the fuze (2) by the liquid corrosive agent (6) and treating it by pyrolysis.

7 Claims, 1 Drawing Sheet

U.S. PATENT DOCUMENTS 6,603,050 B1 * 8/2003 Heaton ..... 588/203

FOREIGN PATENT DOCUMENTS

| | | |
|---|---|---|
| DE | 197 09 367 C1 | 10/1998 |
| FR | 2 704 641 | 11/1994 |
| WO | WO 92/21918 | 12/1992 |
| WO | WO 96/00880 | 1/1996 |
| WO | WO 98/58890 | 12/1998 |

* cited by examiner

METHOD AND PLANT FOR THE DESTRUCTION OF A FUZE MOUNTED ON A MUNITION

BACKGROUND

The present invention relates to the field of munitions found on a battlefield. It relates more particularly to munitions of all kinds, either those that have been abandoned or those that have been fired, but have not exploded for various reasons; these munitions include their actuating fuzes.

A munition comprises a metal shell containing a main charge of explosive, smoke-generating, incendiary or chemical nature.

To activate the main charge, the munition is equipped with a fuze that includes a firing device containing sensitive materials such as black powder and/or primary explosives and safety mechanisms. Depending on the type of main charge, explosive or dispersion booster charges are interposed between the main charge and fuze.

SUMMARY

Those skilled in the art are well aware that the most sensitive part of a munition is the fuze. The fuze and the main body are packaged in separate packages and are assembled only at the moment of use. A munition deprived of its fuze is therefore considered as very safe.

The fuze itself generally includes a safety mechanism, that is to say a means of interrupting the pyrotechnic chain which, before use, is in the safety position. In this safety position, the primary explosive is separated from the secondary explosive of the booster charge or of the main charge: the initiation of the primary explosive by percussion, for example, cannot cause the other charges to detonate. At the moment of use, this safety device is removed either intentionally by an operator or automatically under the effect of the firing acceleration in the case of a shell: a percussion that initiates the primary charge can therefore cause the detonation of the other charges and the explosion of munition.

The munitions considered here are conventional munitions producing a blast and shrapnel effect (the main charge is an explosive), but also munitions containing a smoke-generating composition or an incendiary composition (main charge) that is dispersed during the explosion of the booster charge in order to produce a screening defect or to propagate a fire. Finally, they may be chemical munitions that contain at least one toxic chemical agent dispersed by the explosion of the booster charge—these chemical agents are known as "combat gases".

These munitions found on a battlefield, often several decades after the events (more particularly those of the first and second world wars) are in a poor state. Above all, there is a major risk of said munitions exploding: the fuze is mounted in the munition and its state (safe or otherwise) is unknown. There is no possible protection from this risk of explosion for the operator.

The problem to be solved is therefore how to bring the munition into a state such that it can be transported to a site or plant for destruction under conditions that meet several constraints, namely personal protection, environmental protection and compliance with the regulations in force.

In a different field from the context in which we are placed, patent FR 2 704 641 discloses an automatic plant for the neutralization of chemical munitions. To gain access to the inside of the munition and neutralize the chemical charge, this installation includes a means for separating the fuze from the body of the munition. Said means consists of a water jet lance, the water being mixed with abrasive particles, which cuts out the fuze, the latter then being collected in a support; appropriate means are then used to introduce, into the munition, an agent that dissolves the charge of chemical agent. It is obvious that this means of separating the fuze from the body of the munition cannot be used to solve our problem: the method is too aggressive for a fuze the state of which is unknown (fuze in the safe position or not).

The chemical machining or corrosion of mechanical parts, relatively large in size and of complex shapes, are also known. However, the use of these techniques for dismantling munitions poses several problems. First of all the choice of a corrosive agent of quite simple but effective composition; then the choice of compatibility of said corrosive agent with the products encountered or that will be encountered during the action of the corrosive agent on the munition, especially on primary or secondary explosives, possibly other compositions (smoke or incendiary bombs) and possibly chemical agents. Finally, a difficult and important problem is that of treating the mixture resulting from the action of the corrosive agent on the munition. This mixture cannot be discharged as such, and its chemical neutralization is very tricky.

The present invention relates to a method for the destruction of fuzes mounted on munitions, each munition comprising especially a body and an explosive dispersion charge initiated by a fuze, said method consisting in placing at least one munition in a closed chamber, characterized in that the following cycle of operations is carried out at least once:

- a reduced pressure is created in the chamber;
- the fuze is dissolved by a corrosive liquid agent;
- the gaseous effluents are withdrawn to an auxiliary chamber for subsequent treatment;
- after the fuze has been dissolved, the chamber is reopened;
- the munition is removed and packaged for subsequent treatment;
- optionally, another destruction cycle is carried out until the corrosive agent is no longer sufficiently corrosive to provide an additional cycle;
- the liquid mixture resulting from etching away the fuzes by the corrosive liquid agent is then recovered; and
- said mixture is then treated by pyrolysis;
- solid or pasty deposits are recovered, suitably packaged for subsequent treatments.

The gaseous effluents withdrawn are essentially those resulting from the dissolution of the fuze by the corrosive liquid agent, these gaseous effluents are also those escaping from the munition (for example, toxic gases) if the action of the corrosive liquid agent on the fuze has been extended to beyond the dissolution of the part containing the primary charge of the fuze. A reduced pressure is created in the chamber where the dissolution takes place in order to avoid any dispersion of these gaseous effluents to the outside. The chamber is reopened after the atmosphere in the chamber has been purged or flushed out. The munition, from which the fuze has been dissolved and therefore for which the risk of an explosion is considerably reduced, or even eliminated, is placed in an appropriate container for a subsequent treatment to destroy the munition and its constituents.

In a first method of implementing the invention, the fuze is dissolved by immersing said fuze in the corrosive liquid agent. Advantageously, only the fuze of the munition is immersed in the corrosive liquid agent. The corrosive liquid agent is stirred by suitable means in order to promote the action of said corrosive liquid on the metal of the fuze.

In a second method of implementing the invention, the fuze is dissolved by spraying or sprinkling said fuze with the corrosive liquid agent. Since in this method of implementation the corrosive liquid is often fresh liquid, the limitation on the number of cycles carried out will be determined by the capacity of the chamber, more precisely by the capacity of the tank that collects the corrosive sprinkling liquid. The sprinkling zone may be confined using a screen placed around the desired zone.

In a third method of implementing the invention, the fuze is dissolved by applying a corrosive pad against said fuze. The corrosive liquid agent is immobilized by an absorbent or gelling material in order to produce the pad.

The corrosive liquid agent is chosen from those normally used in chemical machining. The nature of the corrosive liquid agent used is determined by the nature of the constituent material of the fuze. Advantageously, if the fuze is based on iron or steel, for example in the case of shells, the liquid is essentially a nitric acid solution, the normality of which is between 3 and 9.

If the fuze is based on aluminum, for example in the case of aviation bombs, the liquid is essentially a sodium hydroxide solution or potassium hydroxide solution or a mixture, the normality of which is between 1 and 10.

Preferably, the initial temperature of the corrosive liquid agent for sprinkling onto the fuze of the munition or at the start of immersion is above room temperature in order to have a sufficient rate of dissolution. For example, in the case of a nitric acid solution, the initial temperature is above 40° C.

More preferably, the temperature of the corrosive liquid agent in which the fuze of the munition is immersed is regulated, between about 65° C. and about 90° C., by suitable methods that limit the heating of the munition.

Preferably, the pyrolysis of the resulting liquid mixture recovered from the chamber, after at least one destruction cycle, is carried out in a rotary furnace, the inlet temperature of which is about 400° C. and the outlet temperature of which is about 800° C. The resulting liquid mixture is, for example, mixed with an absorbent and combustible material (wood chips or sawdust, etc.) that is incinerated in said furnace in order to produce the thermal influx necessary for pyrolysis. This incineration also includes the appropriate treatment of the flue gases from the incineration and the pyrolysis.

Advantageously, the munition removed from the chamber after its fuze has been destroyed is transported to an appropriate plant.

Advantageously in the case of chemical munitions, the operation may be continued until destruction of the contents of the munition. The term "destruction" should be understood here to mean the effective destruction of the constituents, their dissolution or their disassociation and their dispersion in the liquid agent that will then phlegmatize these constituents.

For example, when the corrosive liquid agent used is nitric acid, the proprietor has verified that the nitric acid had no effect on black powder, on primary explosives, such as mercury fulminate and lead styphnate, or on secondary explosives, such as tolite or hexogen. When the action of dissolving the fuze with nitric acid may bring the nitric acid into contact with other compounds contained in the munition, it is necessary, here again, to check the behavior of said acid. Although nitric acid dissolves compounds such as $SnCl_4$ and $TiCl_4$, destroys yperite or partially hydrolyses phosgene, it has no effect on certain arsenic-containing compounds, on chloropicrine and smoke-generating compounds: these substances must therefore be treated by means other than by the action of the corrosive agent.

The present invention also relates to a plant for implementing the method described above. This plant essentially comprises a chamber closed by a cover. The chamber and the cover must be resistant to any vapors of the corrosive liquid agent. Appropriate means are used to create a reduced pressure in the chamber. The cover includes devices for withdrawing the gaseous effluents to an auxiliary chamber. The tank containing the corrosive liquid agent is made of a material resistant to said corrosive agent and it includes means for regulating the temperature of the mixture during dissolution of the fuze. Optionally, the tank includes means for sprinkling the agent onto the fuzes. The tank also includes means for separating the liquid part from the solid or pasty part of the mixture resulting from the dissolution of the fuze by the corrosive liquid agent.

Finally, the chamber includes means for fastening the munition, allowing it to be lowered in order to be partially or completely immersed in the corrosive liquid agent, and for removing it from this liquid and from the chamber.

The chamber also includes a number of peripheral installations:

- an installation for preparing the solution of corrosive liquid agent to the suitable composition and to the suitable concentration;
- an auxiliary chamber for storing or treating the gaseous effluents from the dissolution reaction; and
- various containers for containing the munition, the fuze of which has been destroyed, and the liquid or solid and pasty mixtures resulting from the dissolution of the fuze and from possible opening of the munition.

Advantageously, said plant is a movable plant that can be brought as close as possible to the site of discovery of the munitions to be treated. If the conditions of discovery so require and so allow, the destruction of the fuzes is almost in situ.

The present invention clearly solves the problems posed. The fuze is separated from the body of the munition gently, under satisfactory safety conditions. The products resulting from this separation—in fact destruction of the fuze—may be treated simply by processes known elsewhere. The munition, stripped of its fuze, is in a configuration in which it can be handled and transported without any danger to an installation where it will be destroyed.

BRIEF DESCRIPTION OF THE DRAWINGS

The invention will be explained in further detail below with the aid of FIG. 1.

DETAILED DESCRIPTION OF EMBODIMENTS

Figure 1:
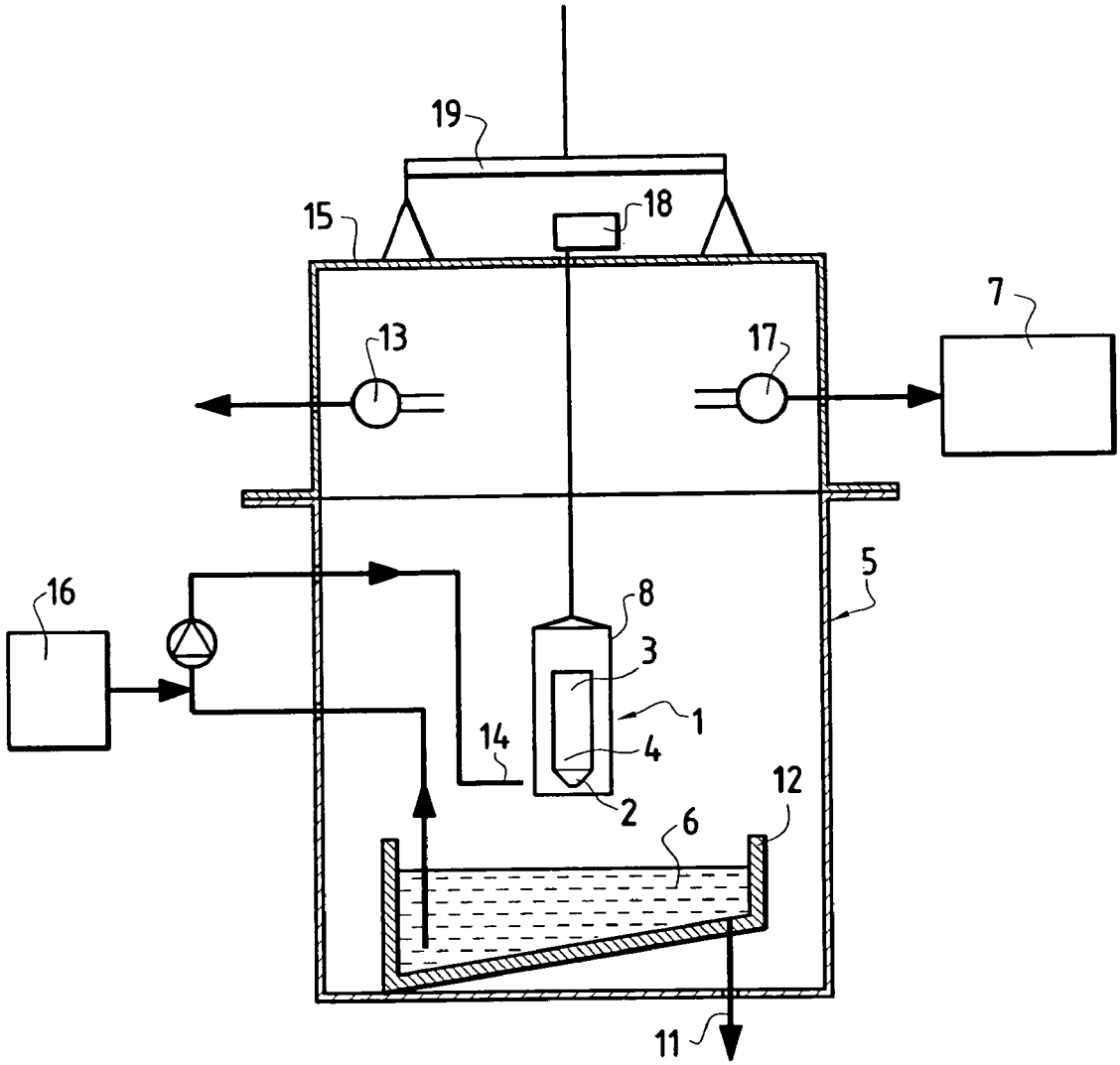
FIG. 1 shows schematically the particular case of the destruction of a shell fuze.

The plant for destroying a fuze 2 mounted in a munition 1 comprises a chamber 5 closed by a cover 15. The chamber 5, the cover 15 and the devices that are associated therewith must be resistant to the possible vapors of the corrosive agent. The cover 15 includes devices 13 for creating a reduced pressure in the chamber 5 in order to avoid gaseous emanations to the outside; the cover acts as a suction hood. Optionally, the cover 15 may seal the chamber 5. The cover 15 includes devices 17 for withdrawing the gaseous effluents that are then stored in an auxiliary chamber 7. The cover 15 includes handling devices 19 matched to the size of the cover 15. Inside the chamber 5 there is a tank 12 that contains the corrosive liquid agent 6 and the mixtures resulting from the dissolution of the fuze 2 and any liquid or solid products that escape from the munition 1 if the latter is opened while the fuze 2 is being destroyed. This tank 12 is, for example, a double-walled tank in order to regulate the temperature of its contents. The tank 12 includes mechanical or pneumatic devices (gas bubbling) in order to homogenize the mixture (these means have not been shown in the present diagram). The tank 12 is made of a material resistant to the corrosive liquid agent 6 within the temperature range; for example, the tank 12 may be made of polypropylene.

The tank 12 optionally includes a device 14 for sprinkling the fuze 2 with the corrosive liquid agent 6. The sprinkling device 14 is fed either directly from a reservoir 16 containing fresh corrosive agent or by taking up the liquid mixture from the tank 12.

The tank 12 also includes means for separating the liquid part 6 from the solid or pasty part resulting from the dissolution of the fuze 2 by the corrosive liquid agent. A draining device 11 on the tank 12 allows the liquid mixture to be withdrawn for its subsequent treatment.

The cover 15 includes a device 8 for fastening the munition 1. The munition 1 is installed vertically in the device 8, its tip containing the fuze 2 pointing downward. For example, the fastening device 8 is a simple net made of polypropylene resistant to the corrosive agent, or a cage that can take one or more munitions 1, or else a grab with self-locking jaws in order to hold the munition 1 by its guiding collar. The fastening device 8 is connected to a handling device 18 which brings the tip of the munition 1 to the level of the sprinkling device 14 or immerses the tip of the munition 1 into the liquid in the tank 12. The handling device 18 also makes it possible for the munition 1 to be rapidly raised and therefore for the dissolution reasons to be stopped in the event of any anomaly.

A fuze destruction cycle starts with the plant open:

by installing the munition 1 in the fastening device 8;

the munition 1, which includes a body 3 and an explosive dispersion charge 4, is placed vertically, with the fuze 2 pointing downwards;

the cover 15, with the fastening device 8 connected to the handling device 18, is brought onto the chamber 5—it is lowered in order to close the chamber 5. The device 13 for creating a reduced pressure and the withdrawal device 17 are connected up. The handling device 18 either brings the tip of the munition 1 level with the height of the sprinkling device 14, which is then activated, or immerses the tip of the munition into the solution contained in the tank 12. The reaction of dissolving the fuze 2 starts; and at the end of dissolution, the atmosphere in the chamber 5 is flushed out by a gas. The devices 13 and 17 are disconnected and the cover 15 is raised and moved so as to remove the munition, without its fuze that has been destroyed, from the fastening device 8.

The description relates to a single munition but it is obvious that several munitions may be treated simultaneously depending on the size of the munitions and that of the plant.

The invention claimed is:

1. A method for destroying fuzes mounted in munitions, each munition comprising a body and an explosive dispersion charge initiated by a fuze, with at least one munition in a closed chamber, wherein the following cycle of operations is carried out at least once:

a reduced pressure is created in the chamber;

only the fuze of the munition is dissolved by a corrosive liquid agent;

gaseous effluents are withdrawn to an auxiliary chamber for subsequent treatment;

after the fuze has been dissolved, the chamber is reopened;

the munition is removed and packaged for subsequent treatment; and another destruction cycle is capable of being carried out until the corrosive liquid agent is no longer sufficiently corrosive to provide an additional cycle.

2. The method as claimed in claim 1, wherein the fuze is dissolved by immersing said fuze in the corrosive liquid agent.

3. The method as claimed in claim 1, wherein the fuze is dissolved by sprinkling said fuze with the corrosive liquid agent.

4. The method as claimed in claim 1, wherein the corrosive liquid agent essentially comprises a nitric acid solution whose normality is between 3 and 9.

5. The method as claimed in claim 1, wherein the corrosive liquid agent essentially comprises a sodium hydroxide solution, a potassium hydroxide solution or a mixture thereof, a normality of which is between 1 and 10.

6. The method as claimed claim 1, wherein an initial temperature of the corrosive liquid agent is greater than 40° C.

7. The method as claimed in claim 1, wherein a temperature of the corrosive liquid agent is regulated between about 65° C. and about 90° C.

* * * * *